US007261370B1

(12) United States Patent
Whitesell, Jr. et al.

(10) Patent No.: US 7,261,370 B1
(45) Date of Patent: Aug. 28, 2007

(54) HIGH CHAIR APPARATUS

(76) Inventors: Robert C. Whitesell, Jr., 2133 Route 380, Saltsburg, PA (US) 15681; Cindy E. Whitesell, 2133 Route 380, Saltsburg, PA (US) 15681

( * ) Notice: Subject to any disclaimer, the term of this patent is extended or adjusted under 35 U.S.C. 154(b) by 223 days.

(21) Appl. No.: 11/002,917

(22) Filed: Dec. 3, 2004

(51) Int. Cl.
*A47B 83/02* (2006.01)

(52) U.S. Cl. ..... 297/153

(58) Field of Classification Search ..... 297/148, 297/153, 174 R, 188.04, 174; 108/90
See application file for complete search history.

(56) References Cited

U.S. PATENT DOCUMENTS

| | | | | | |
|---|---|---|---|---|---|
| 1,135,269 | A * | 4/1915 | Dudley | 108/90 |
| 1,371,475 | A * | 3/1921 | Ernst | 297/155 |
| 2,022,955 | A * | 12/1935 | Davis | 297/153 |
| 3,729,037 | A * | 4/1973 | Dare et al. | 150/158 |
| 4,606,576 | A | 8/1986 | Jones | |
| 4,640,033 | A | 2/1987 | Bulger | |
| 4,723,813 | A * | 2/1988 | Kassai | 297/153 |
| 4,841,878 | A * | 6/1989 | Kriegsman | 108/90 |
| 4,944,968 | A * | 7/1990 | Wagner | 428/13 |
| 5,294,172 | A | 3/1994 | Dubus | |
| D409,026 | S | 5/1999 | Rosko et al. | |
| 6,497,452 | B2 | 12/2002 | Catelli | |
| 6,578,496 | B2 | 6/2003 | Guard et al. | |
| 6,851,375 | B2 * | 2/2005 | Guard et al. | 108/25 |
| 6,932,426 | B2 * | 8/2005 | Greger | 297/149 |
| 7,134,714 | B1 * | 11/2006 | Connery | 297/153 |
| 2003/0110674 | A1 * | 6/2003 | Ernst | 40/773 |

* cited by examiner

*Primary Examiner*—Joe Edell

(57) ABSTRACT

A high chair apparatus includes a chair that includes a pair of arm rails. A tray has an inner edge and an outer edge. Couples attached to the tray are adapted for removably coupling the tray to the arm rails. A plate has a same size and shape as the tray. A transparent plate has a rear edge, a front edge, a first lateral edge and a second lateral edge. The rear edge may be aligned with the outer edge of the tray. A lip is attached to and extends along the rear edge, the first lateral edge and the second lateral edge. A lower portion of the lip extending below the plate has an elongated notch therein. Each of a plurality of panels has learning indicia thereon that is selected from the group including shapes, letters and numerals. Each of the panels is selectively extendable in the notch.

7 Claims, 4 Drawing Sheets

HIGH CHAIR APPARATUS

BACKGROUND OF THE INVENTION

1. Field of the Invention

The present invention relates to high chair devices and more particularly pertains to a new high chair device that includes a tray that is adapted for displaying learning cards.

2. Description of the Prior Art

The use of high chair devices is known in the prior art. U.S. Pat. No. 6,578,496 describes a tray that includes a depression therein for accepting smaller trays that include food dividers therein. Another type of high chair device is U.S. Pat. No. 5,294,172 having a transparent tray, which includes a game sealed therein and external actuators for actuating pieces of the game. A similar device is found in U.S. Pat. No. 6,497,542 and includes a tray having a plurality of depressions therein for receiving food containers and the like.

While these devices fulfill their respective, particular objectives and requirements, the need remains for a device that allows a person to place educational cards within a tray so that they may be viewed by a chilled seated in a high chair. This positioning ensures that the cards are always within view of the child and will provide an excellent opportunity to expose the child to the educational cards.

SUMMARY OF THE INVENTION

The present invention meets the needs presented above by generally comprising a chair has a seat portion and a back portion that is attached to and extends upwardly from a back edge of the seat portion. A pair of arm rails and a plurality of legs are attached to the chair. A tray has a top side, a bottom side, an inner edge, an outer edge, a first side edge and a second side edge. Each of a pair of couplers is attached to a bottom side of the tray and each is positioned and adapted for removably coupling to one of the arm rails. A plate has a same size and shape as the tray. The plate has a rear edge, a front edge, a first lateral edge and a second lateral edge. The rear edge may be aligned with the outer edge of the tray. The plate is transparent. A lip is attached to and extends along the rear edge, the first lateral edge and the second lateral edge. The lip includes an upper portion extending upwardly from the plate and a lower portion extending downwardly from the plate. The lower portion of the lip has an elongated notch therein extending from a bottom edge of the lip to the plate. The notch is positioned adjacent to the rear edge. Each of a plurality of panels has learning indicia thereon that is selected from the group including shapes, letters and numerals. Each of the panels is selectively extendable in the notch and positionable between the tray and the plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
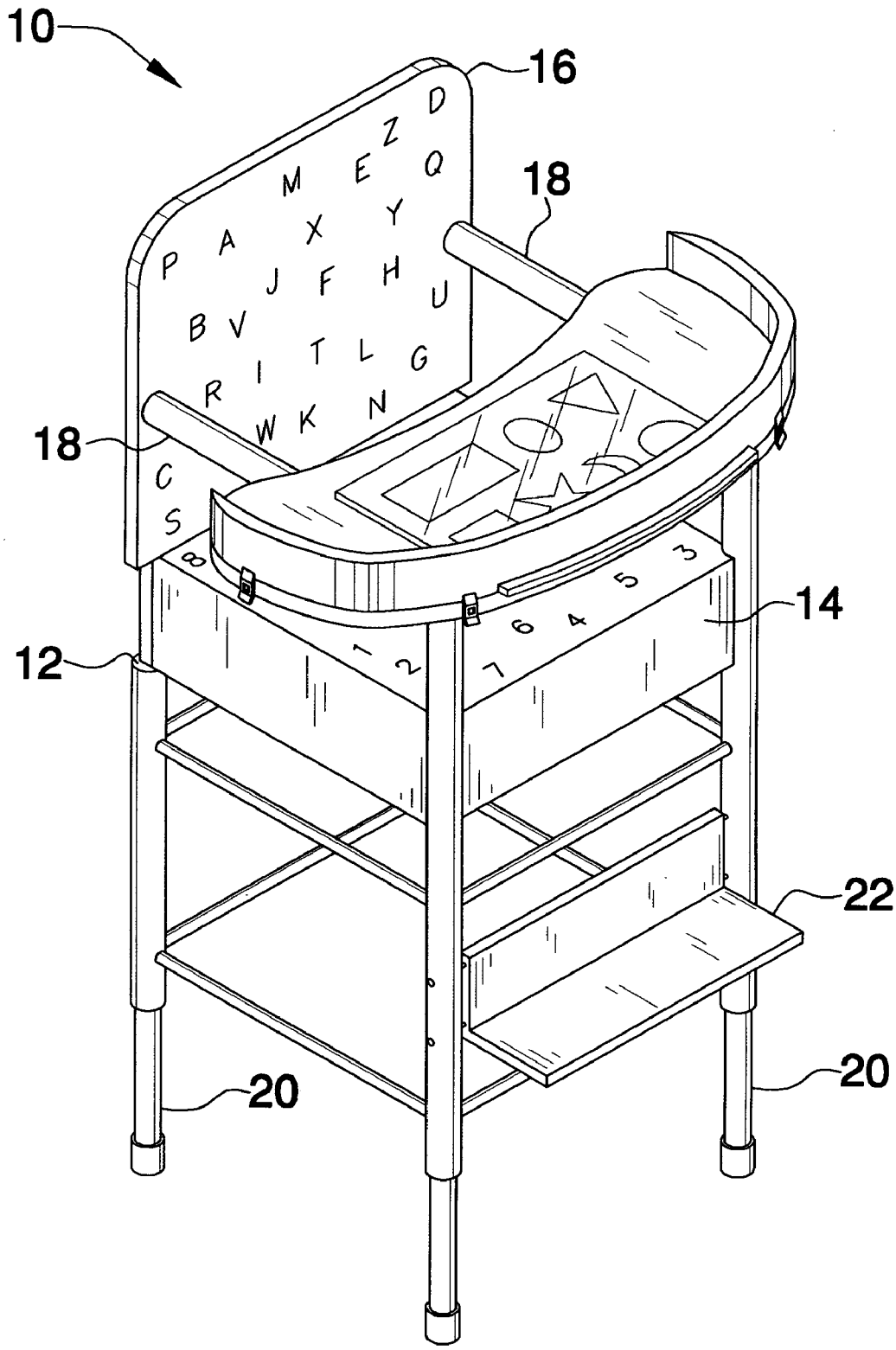
FIG. 1 is a perspective view of a high chair apparatus according to the present invention.
Figure 2:
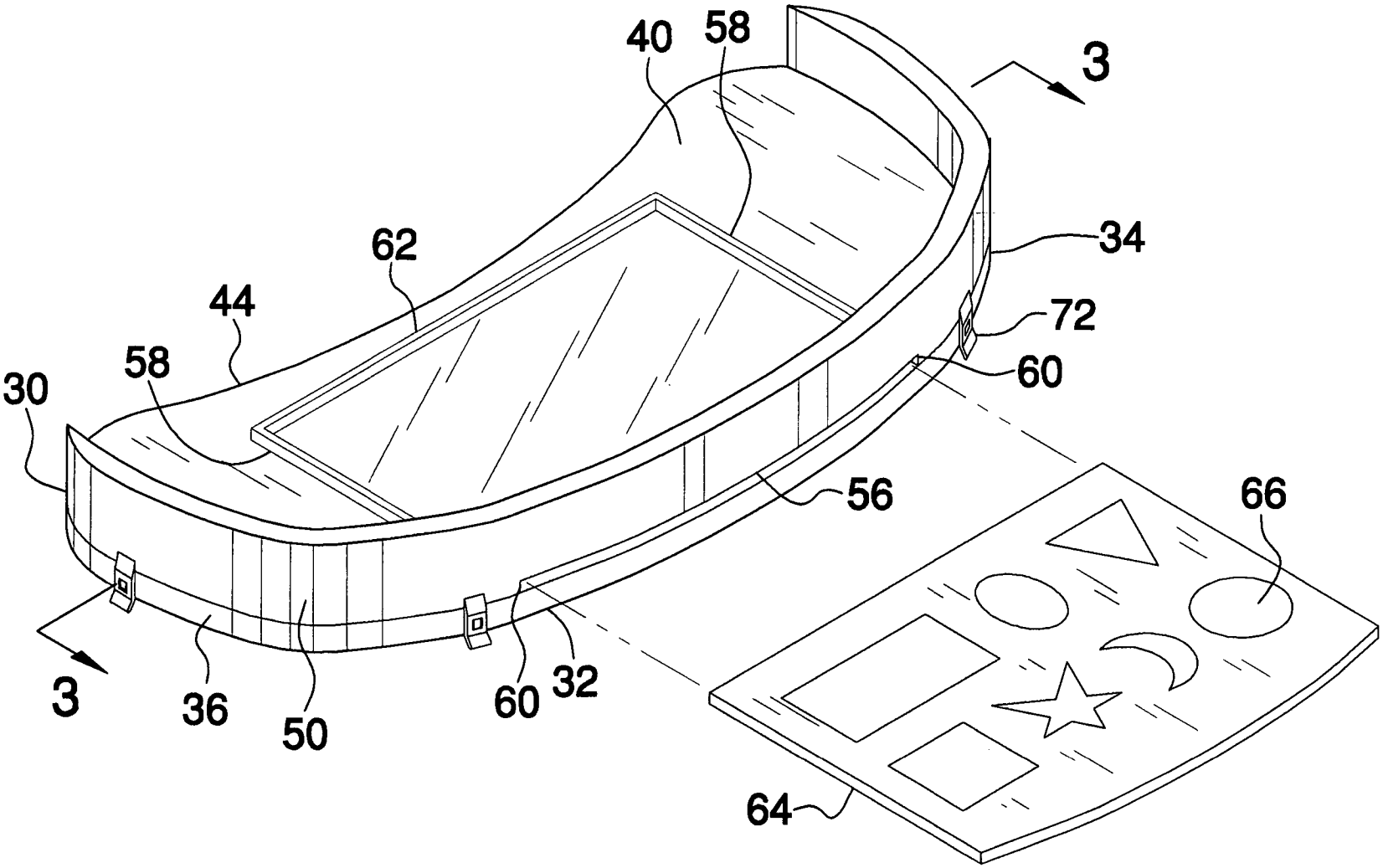
FIG. 2 is a perspective view of the present invention.

With reference now to the drawings, and in particular to FIGS. 1 through 6 thereof, a new high chair device embodying the principles and concepts of the present invention and generally designated by the reference numeral 10 will be described.

As best illustrated in FIGS. 1 through 6, the high chair apparatus 10 generally comprises a chair 12 has a seat portion 14 and a back portion 16 that is attached to and extends upwardly from a back edge of the seat portion 14. A pair of arm rails 18 and a plurality of legs 20 are attached to the chair 12. The chair 12 apparatus is generally conventional high chair device that includes a footrest 22. The legs 20 are preferably telescoping.

A tray 24 has a top side 26, a bottom side 28, an inner edge 30, an outer edge 32, a first side edge 34 and a second side edge 36. The inner edge 30 has a concave arcuate shape and the outer edge 32 has a convex arcuate shape. A pair of couplers 38 is attached to a bottom side 28 of the tray 24. Each of the couplers 38 is positioned and adapted for removably coupling to one of the arm rails 18.

Figure 3:
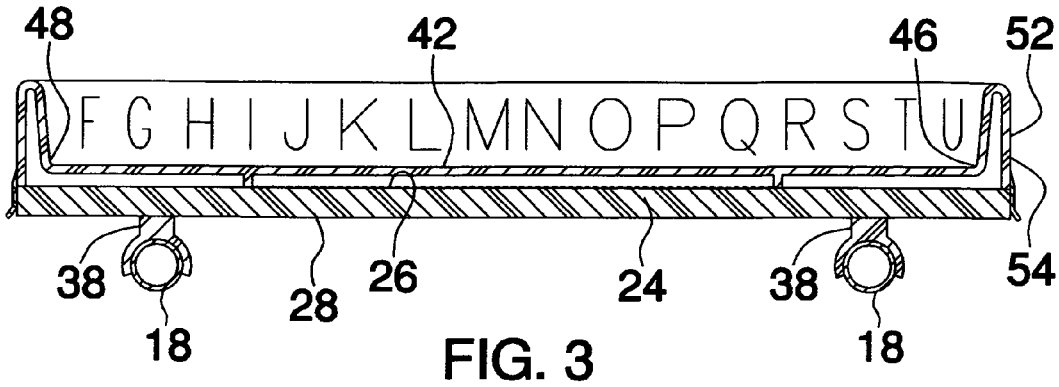
FIG. 3 is a cross-sectional view taken along line 3-3 of FIG. 2 of the present invention.
Figure 4:
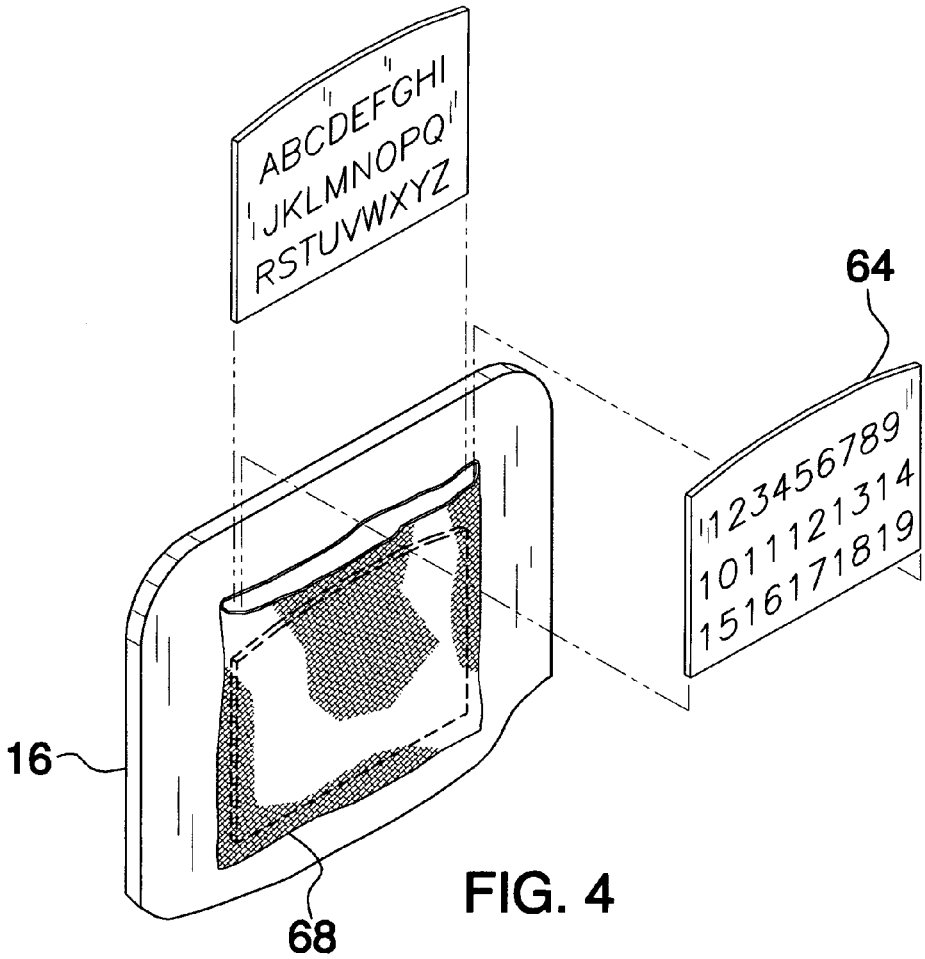
FIG. 4 is a back view of the present invention.
Figure 5:
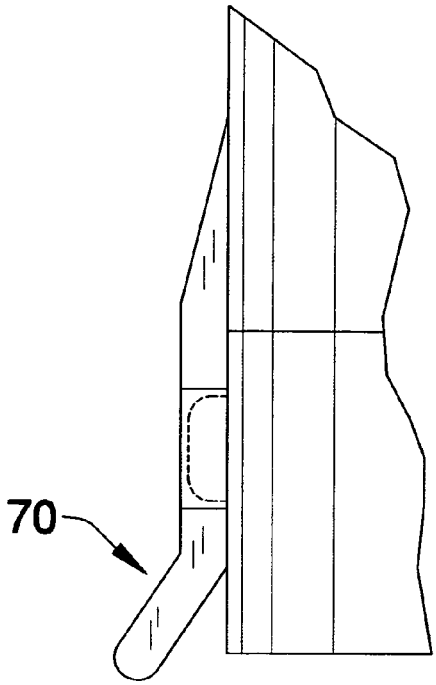
FIG. 5 is a side view of a fastening member of the present invention.
Figure 6:
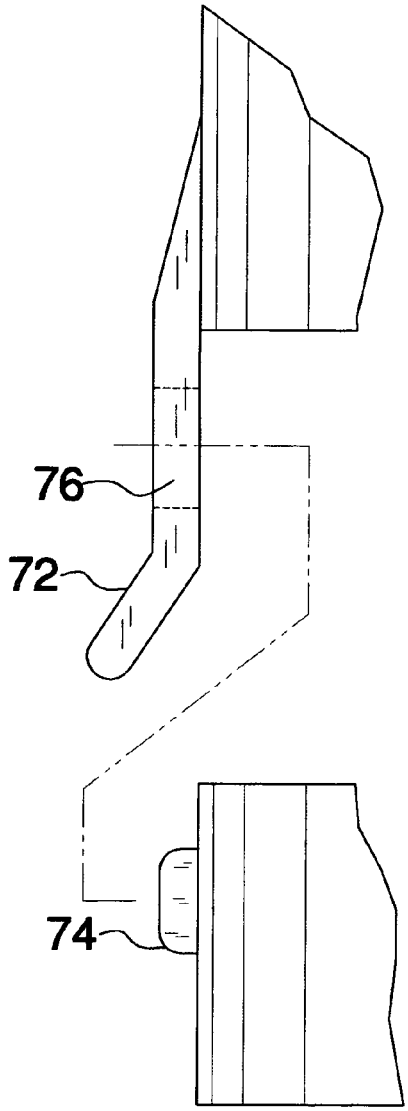
FIG. 6 is a side view of the fastening member of the present invention.

A plate 40 has a same size and shape as the tray 24. The plate 40 has a rear edge 42, a front edge 44, a first lateral edge 46 and a second lateral edge 48. The rear edge 42 may be aligned with the outer edge 32 of the tray 24. The plate 40 is substantially transparent. A lip 50 extends along the rear edge 42, the first lateral edge 46 and the second lateral edge 48. The lip 50 includes an upper portion 52 extending upwardly from the plate 40 and a lower portion 54 extending downwardly from the plate 40. The lower portion 54 of the lip 50 has an elongated notch 56 therein extending from a bottom edge of the lip 50 to the plate 40. The lip 50 may be hollow as shown in FIG. 3. The notch 56 is positioned adjacent to the rear edge 42. A pair of side walls 58 is attached to and extends downwardly from the plate 40. Each of the side walls 58 is aligned with and extends away from one of two outer edges 60 of the notch 56. An end wall 62 is attached to and extends between the side walls 58. The end wall 62 is positioned adjacent to the front edge 44 of the plate 40. The side 58 and end 62 walls have a height equal to a height of the lower portion 52 of the lip 50.

Each of a plurality of panels 64 is provided. Each of the panels 64 has learning indicia 66 thereon. The learning indicia 66 are selected from the group including shapes, letters and numerals. The letters may be arranged to form words and the shapes may include geometric shapes as well as figures of animals or objects. Each of the panels 64 is selectively extendable in the notch 56 so that it is positioned between the tray 40 and the plate 24. A pocket 68 is attached to a back side of the back portion 16. The panels 64 are removably positionable in the pocket 68 for storage purposes.

Each of a plurality of fastening members 70 is adapted for releasably securing the plate 40 to the tray 24 so that the rear edge 44 is aligned with the outer edge 30. Each of the fastening members 70 includes a tab 72 attached to the lower portion 54 of the lip 50 and a corresponding nub 74 attached to the tray 24. Each of the tabs 72 has a depression 76 therein for receiving the corresponding one of the nubs 74.

In use, the high chair 10 is used as a conventional high chair. A caregiver may position the panels 64 under the plate 40 so that a child, sitting in the high chair, may view the panel 64 through the plate 40. Aside from retaining articles on the plate 40, the upper lip 50 preferably also has indicia thereon. When not in use, the panels 64 are stored in the pockets 68. The end 62 and side 58 walls prevent the panels 64 from moving away from the notch 56 to ensure that it can be reached and easily replaced with another panel 64.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A highchair assembly comprising:

a chair having a seat portion and a back portion being attached to and extending upwardly from a back edge of said seat portion, a pair of arm rails and a plurality of legs being attached to said chair;

a tray having a top side, a bottom side, an inner edge, an outer edge, a first side edge and a second side edge;

a pair of couplers, each of said couplers being attached to a bottom side of said tray, each of said couplers being positioned and adapted for removably coupling to one of said arm rails;

a plate having a same size and shape as said tray, said plate having a rear edge, a front edge, a first lateral edge and a second lateral edge, wherein said rear edge may be aligned with said outer edge of said tray, said plate being substantially transparent;

a lip extending along said rear edge, said first lateral edge and said second lateral edge, said lip including an upper portion extending upwardly from said plate and a lower portion extending downwardly from said plate, said lower portion of said lip having an elongated notch extending therethrough and extending from a bottom edge of said lip to said plate, said notch being positioned adjacent to said rear edge;

a plurality of panels, each of said panels having learning indicia thereon, said learning indicia being selected from the group including shapes, letters and numerals, each of said panels being selectively extendable in said notch and positionable between said tray and said plate;

a plurality of fastening members being adapted for releasably securing said plate to said tray such that said rear edge is aligned with said outer edge.

2. The assembly according to claim 1, wherein said inner edge has a concave arcuate shape and said outer edge has a convex arcuate shape.

3. The assembly according to claim 1, further including a pair of side walls being attached to and extending downwardly from said plate, each of said side walls being aligned with and extending away from one of two outer edges of said notch, an end wall being attached to and extending between said side walls, said end wall being positioned adjacent to said front edge of said plate.

4. The assembly according to claim 3, further including a pocket being attached to a back side of said back portion, said panels being removably positionable in said pocket.

5. The assembly according to claim 1, wherein each of said fastening members includes a tab attached to said lower portion of said lip and a corresponding nub attached to said tray, each of said tabs having a depression therein for receiving the corresponding one of said nubs.

6. The assembly according to claim 1, further including a pocket being attached to a back side of said back portion, said panels being removably positionable in said pocket.

7. A highchair assembly comprising:

a chair having a seat portion and a back portion being attached to and extending upwardly from a back edge of said seat portion, a pair of arm rails and a plurality of legs being attached to said chair;

a tray having a top side, a bottom side, an inner edge, an outer edge, a first side edge and a second side edge, said inner edge having a concave arcuate shape, said outer edge having a convex arcuate shape;

a pair of couplers, each of said couplers being attached to a bottom side of said tray, each of said couplers being positioned and adapted for removably coupling to one of said arm rails;

a plate having a same size and shape as said tray, said plate having a rear edge, a front edge, a first lateral edge and a second lateral edge, wherein said rear edge may be aligned with said outer edge of said tray, said plate being substantially transparent;

a lip extending along said rear edge, said first lateral edge and said second lateral edge, said lip including an upper portion extending upwardly from said plate and a lower portion extending downwardly from said plate, said lower portion of said lip having an elongated notch extending therethrough and extending from a bottom edge of said lip to said plate, said notch being positioned adjacent to said rear edge;

a pair of side walls being attached to and extending downwardly from said plate, each of said side walls being aligned with and extending away from one of two outer edges of said notch, an end wall being attached to and extending between said side walls, said end wall being positioned adjacent to said front edge of said plate;

a plurality of panels, each of said panels having learning indicia thereon, said learning indicia being selected from the group including shapes, letters and numerals, each of said panels being selectively extendable in said notch and positionable between said tray and said plate;

a plurality of fastening members being adapted for releasably securing said plate to said tray such that said rear edge is aligned with said outer edge, each of said fastening members including a tab attached to said lower portion of said lip and a corresponding nub attached to said tray, each of said tabs having a depression therein for receiving the corresponding one of said nubs; and a pocket being attached to a back side of said back portion, said panels being removably positionable in said pocket.

* * * * *